US007594738B1

(12) United States Patent
Lin et al.

(10) Patent No.: US 7,594,738 B1
(45) Date of Patent: Sep. 29, 2009

(54) LED LAMP WITH REPLACEABLE POWER SUPPLY

(75) Inventors: Kuo-Len Lin, Wugu Township, Taipei County (TW); Chen-Hsiang Lin, Wugu Township, Taipei County (TW); Wen-Jung Liu, Wugu Township, Taipei County (TW); Hwai-Ming Wang, Wugu Township, Taipei County (TW); Ken Hsu, Wugu Township, Taipei County (TW); Chih-Hung Cheng, Wugu Township, Taipei County (TW)

(73) Assignees: Cpumate Inc., Taipei (TW); Golden Sun News Techniques Co., Ltd., Taipei (TW)

( * ) Notice: Subject to any disclaimer, the term of this patent is extended or adjusted under 35 U.S.C. 154(b) by 0 days.

(21) Appl. No.: 12/166,560

(22) Filed: Jul. 2, 2008

(51) Int. Cl.
*F21V 33/00* (2006.01)

(52) U.S. Cl. ..... 362/249.02; 362/800; 362/225; 362/218; 362/294

(58) Field of Classification Search ..... 362/249.02, 362/800, 218, 225, 294
See application file for complete search history.

(56) References Cited

U.S. PATENT DOCUMENTS

| | | | | |
|---|---|---|---|---|
| 5,653,529 | A * | 8/1997 | Spocharski | 362/235 |
| 7,059,743 | B2 * | 6/2006 | Niemann | 362/184 |
| 2004/0246714 | A1 * | 12/2004 | Talamo et al. | 362/225 |
| 2006/0203478 | A1 * | 9/2006 | Waters | 362/217 |
| 2006/0262526 | A1 * | 11/2006 | Dubois | 362/184 |
| 2007/0291473 | A1 * | 12/2007 | Traynor | 362/106 |

* cited by examiner

*Primary Examiner*—Laura Tso

(57) ABSTRACT

An LED lamp with replaceable power supply includes a tubular body, a light module, a power supply, and two power connectors. The light module is disposed within the tubular body. The light module includes a circuit board and a plurality of LEDs. The LEDs are electrically coupled to the circuit board and are disposed on the bottom side of the circuit board. The power supply is replaceably disposed on the light module and is electrically coupled to the circuit board. The two power connectors are respectively coupled to the two ends of the tubular body and are electrically coupled to the power supply.

10 Claims, 7 Drawing Sheets

LED LAMP WITH REPLACEABLE POWER SUPPLY

BACKGROUND

1. Technical Field

The present invention relates to an LED lamp, and in particular, to an LED lamp with replaceable power supply.

2. Description of Prior Art

Application of Light Emitting Diodes (LEDs) in illumination have become increasingly popular in recent years. As compared to the common fluorescent lamps, for example, LED lamps are more compact in size, consumes less power, have longer lamp life and are more environmentally friendly.

FIG. 1 illustrates an LED lamp with LED light sources, which includes a tubular body 10*a*, a light module 20*a*, a power supply 30*a*, and two power connectors 40*a*. Light module 20*a* is deposed within tubular body 10*a*. Light module 20*a* includes a circuit board 21*a* and a plurality of LEDs 22*a*. LEDs 22*s* are disposed on the bottom side of circuit board 21*a* and are electrically coupled thereto. Power supply 30*a* is disposed within tubular body 10*a* on the top side of circuit board 21*a*. Power supply 30*a* is soldered on circuit board 21*a* for electrical connection. Two power connectors 40*a* are also soldered—to power supply 30*a*—for electrical connection, and are sealed to the two ends of tubular body 10*a*.

SUMMARY OF THE INVENTION

In one aspect, the invention features an LED lamp with replaceable power supply that includes a tubular body, a light module, a power supply, and two power connectors. The light module is disposed within the tubular body. The light module includes a circuit board and a plurality of LEDs. The LEDs are electrically coupled to the circuit board and are disposed on the bottom side of the circuit board. The power supply is replaceably disposed on the light module and is electrically coupled to the circuit board. The two power connectors are respectively coupled to the two ends of the tubular body and are electrically coupled to the power supply.

Embodiments may include one or more of the following advantages. The configuration of the LED lamp with replaceable power supply allows easy access to the inside of the tubular body of the LED lamp, whereupon the power supply replaceably coupled to the light module can be easily removed and replaced from the tubular body. Accordingly, when the power supply of the LED lamp dies out after its typical 20,000 hours of use, for example, a user can simply replace the defective component power supply, rather than having to retire the whole LED lamp entirely, thereby maximizing use of all electrical components and reducing operation costs.

The LED lamp with replaceable power supply further allows the light module replaceably disposed within the tubular body of the LED lamp to be easily replaced. Accordingly, when the light module is defective, for example, a user can simply replace the defective component light module, rather than having to retire the whole LED lamp entirely, thereby maximizing use of all electrical components and reducing operation costs.

BRIEF DESCRIPTION OF THE DRAWINGS

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
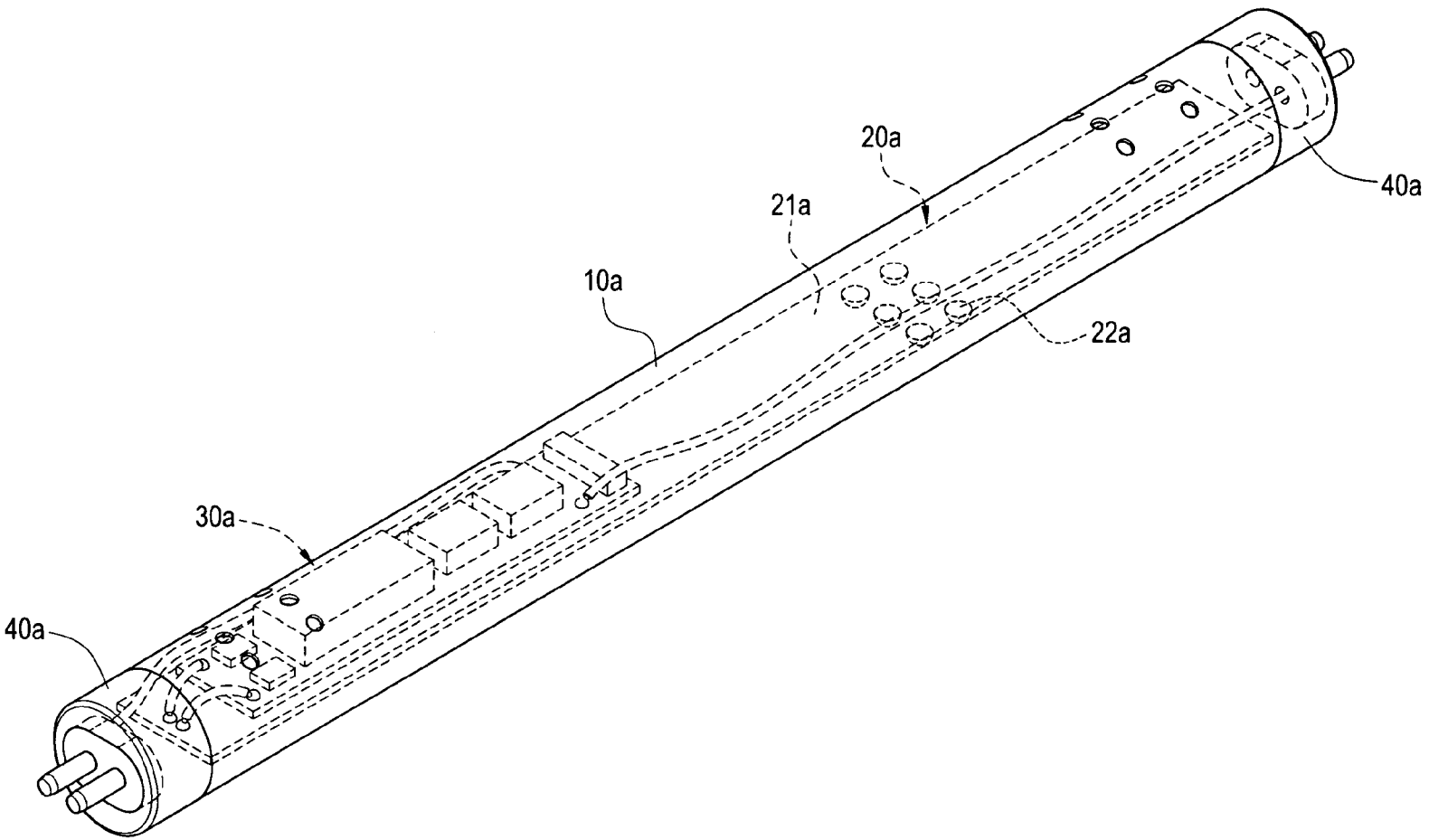
FIG.1 PRIOR ART
FIG. 1 is a three-dimensional view of an LED lamp.
Figure 2:
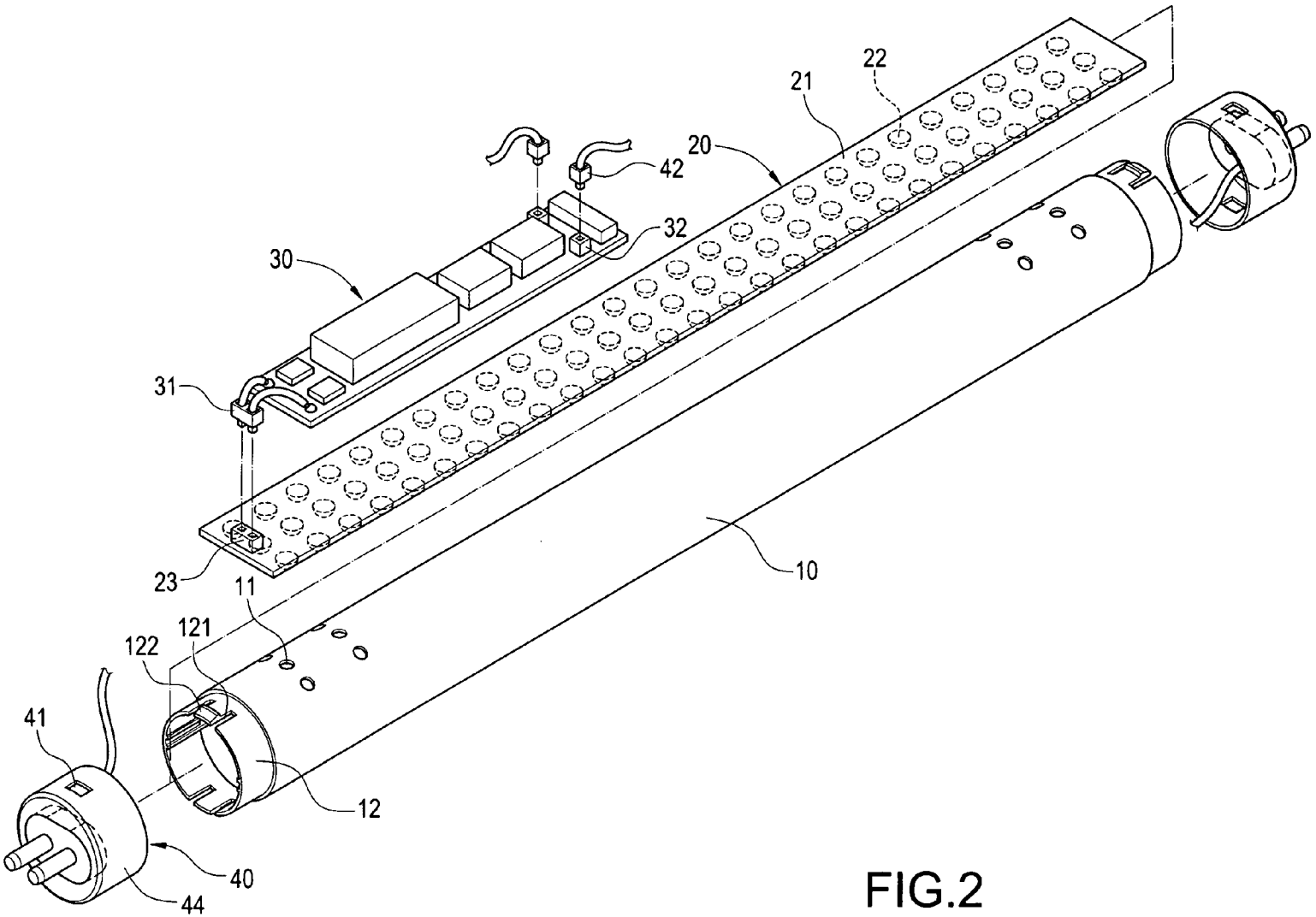
FIG. 2 is a three-dimensional exploded view of an LED lamp with replaceable power supply.
Figure 3:
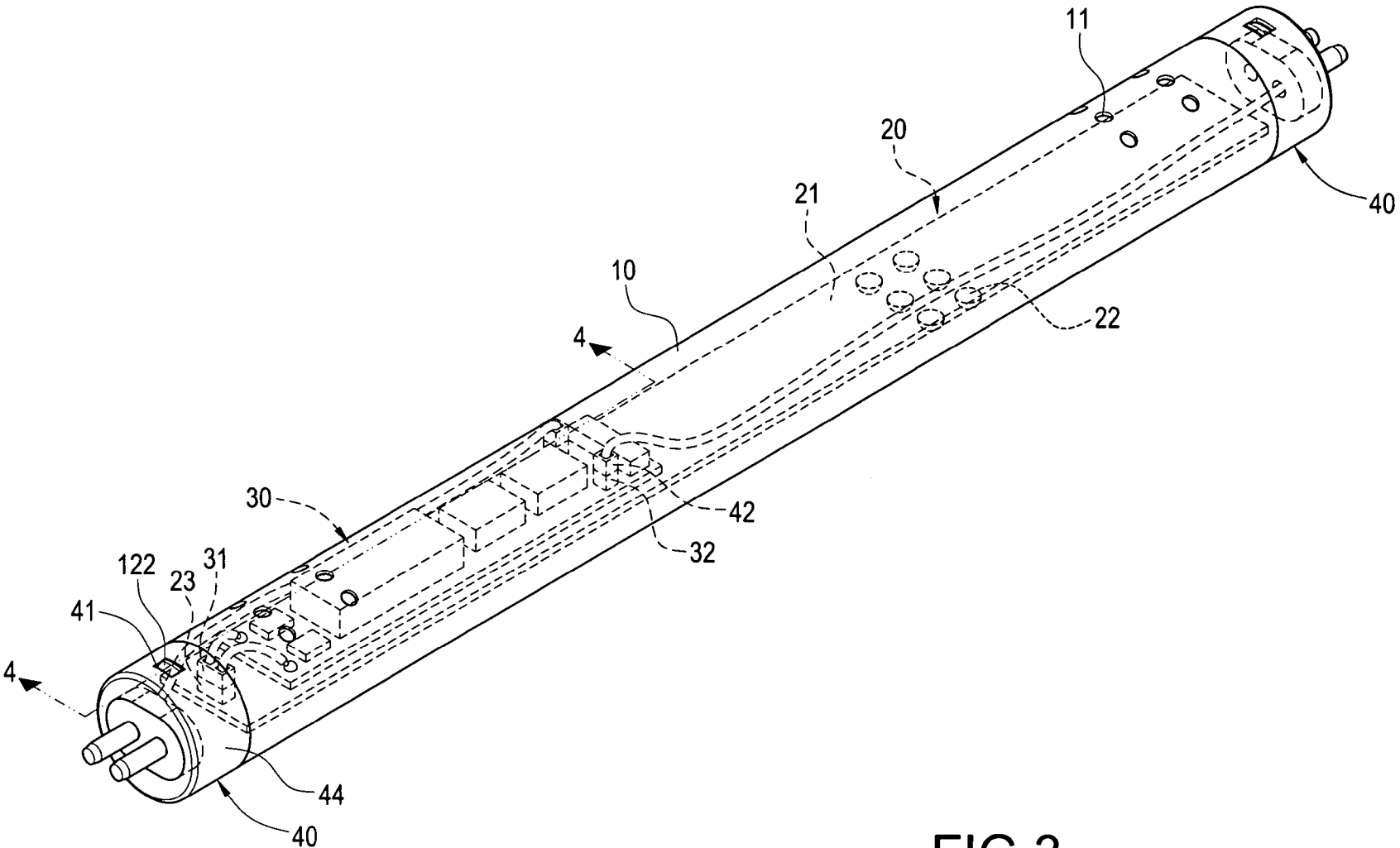
FIG. 3 is a three-dimensional assembly view of an LED lamp with replaceable power supply.
Figure 4:
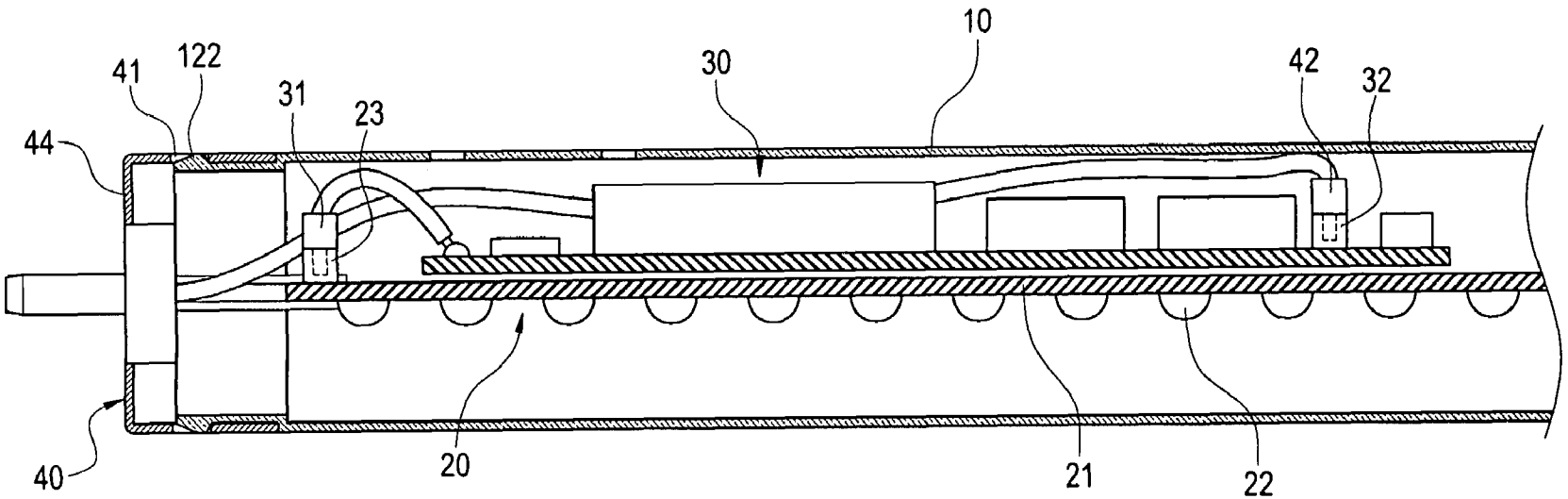
FIG. 4 is a 4-4 cross-sectional view of FIG. 3.

FIGS. 2-4 show an LED lamp with replaceable power supply that includes a tubular body 10, a light module 20, a power supply 30, and two power connectors 40.

Tubular body 10 is made of thin, transparent, and light-transmittable PVC or acrylic materials. Tubular body 10 includes a plurality of venting holes. Venting holes 11 are disposed in a spatial arrangement. The two ends of tubular body 10 are each defined a connecting section 12. Connecting sections 12 each includes two open grooves 121 and a lock hook 122 defined between two open grooves 121.

Light module 20 is replaceably disposed within tubular body 10. Light module 20 includes a circuit board 21, a plurality of LEDs 22, and a first power socket 23. LEDs 22 are electrically coupled to circuit board 21 and are disposed in a spatial arrangement on the bottom side of circuit board 21. First power socket 23 is disposed on circuit board 21 and is electrically coupled to electric circuit 21. Generally, LEDs 22 have a lamp life of about 50,000 hours, and can be yellow LEDs 22, white LEDs 22, blue LEDs or red LEDs, but are not limited thereto. Power supply 30 is replaceably disposed on light module 20 and is disposed on circuit board 21. Power supply 30 has two second power sockets 32 and a power supply plug 31. Power supply plug 31 is adapted to insert in first power socket 23 of light module 20 for electrically coupling to electric circuit 21. Generally, the service life of power supply 30 is about 20,000 hours, shorter than LEDs 22's lamp life of 50,000 hours. Two power connectors 40 are removably coupled to the two ends of tubular body 10 respectively and are electrically coupled to power supply 30. Two power connectors 40 each includes an annular body 44 and lock slots 41. Lock slots 41 are defined on annular body 44 and correspond to lock hook 122 of connecting sections 12. Locks slots 41 adapted to engage with lock hook 122 in a locking configuration. LED lamp with replaceable power supply further includes two power sink plugs 42 that are electrically coupled to two power connectors 40 respectively. Two power sink plugs 42 are adapted to insert in two second power sockets 32 of power supply 30 respectively.

Referring to FIG. 2, to assemble an LED lamp with replaceable power supply, power supply 30 is first displaced on circuit board 21 of light module 20. Power supply plug 31 of power supply 30 is then inserted in first power socket 23 located on circuit board 21. Next, light module 20 and power supply 30 are both disposed within tubular body 10. Then, two power sink plugs 42 of two power connectors 40 are respectively inserted in second power sockets 32 of power supply 30. Finally, two power connectors 40 are respectively coupled to the two ends of tubular body 10.

Referring to FIG. 3, to disassemble an LED lamp with replaceable power supply, two power connectors 40 are first removed from tubular body 10. Two power sink plugs 42 of two power connectors 40 are next unplugged from two second power sockets 32. Next, light module 20 and power supply 30 are removed from within tubular body 10. Lastly, power supply plug 31 of power supply 30 is unplugged from first power socket 23 located on circuit board 21.

Accordingly, when inoperable, power supply 30 or LEDs 22 of light module 20 can be removed for repair or replacement and then re-assembled according to the aforementioned methods. Such ability to replace inoperable LED lamp components provides an alternative to conventional approach where the entire LED lamp has to be replaced, thereby greatly reducing operation costs.

Figure 5:
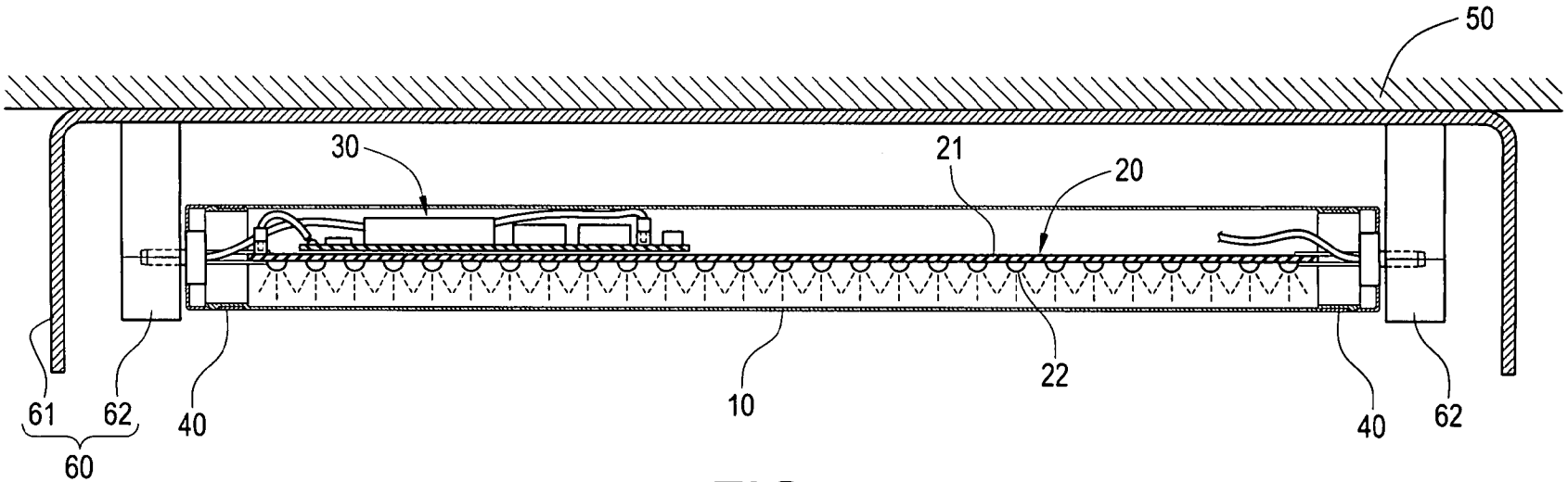
FIG. 5 is an operational diagram of an LED lamp with replaceable power supply.

Referring to FIG. 5, to operate an LED lamp with replaceable power supply, an assembled LED lamp with replaceable power supply is installed in lamp fixture 60. Lamp fixture 60 includes a lamp housing 61 and two electrical sockets 62 disposed within lamp housing 61. Next, two power connectors 40 of LED lamp with replaceable power supply is inserted in two electrical sockets 62 of light fixture 60, whereupon LEDs 22 are powered and provide illumination.

Figure 6:
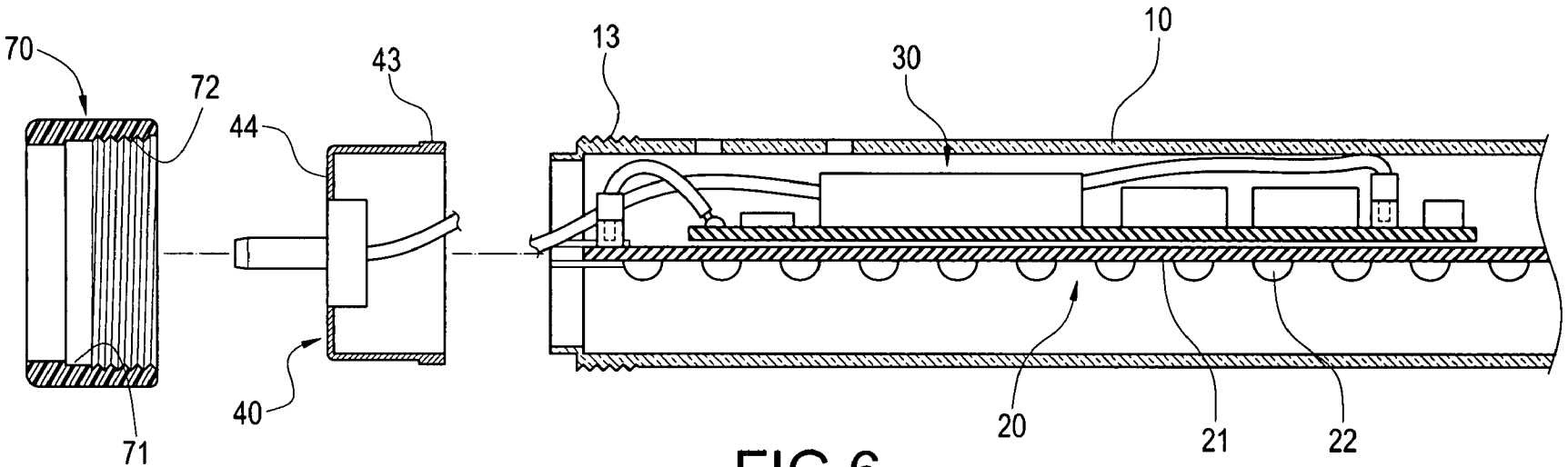
FIG. 6 is a exploded view of an LED lamp with replaceable power supply.
Figure 7:
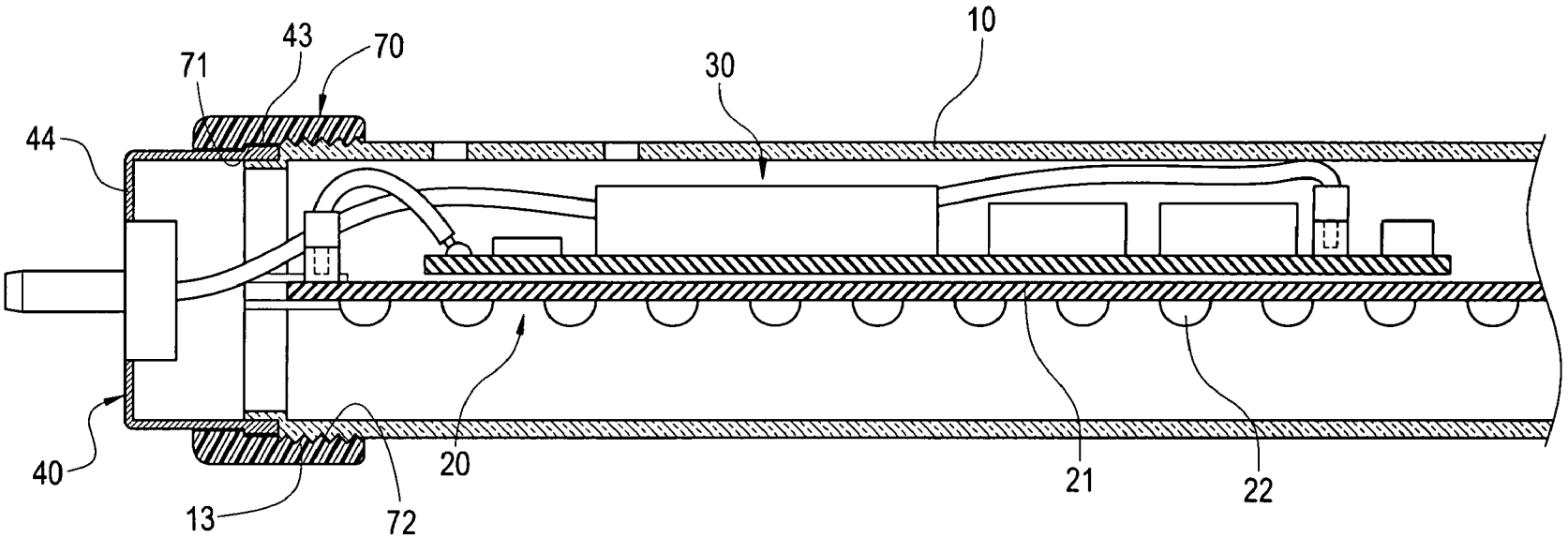
FIG. 7 is an assembled view of FIG. 6.

FIGS. 6 and 7 respectively show an exploded diagram and an assembly diagram of an LED lamp with replaceable power supply according to another embodiment. In this embodiment, the LED lamp with replaceable power supply further includes a nut 70. Nut 70 has a lock groove 71 and an internal thread abutting 72 the lock groove 71 defined therein. Power connectors 40 each has a lock ring 43 on its outer edge adapted to fit within lock groove 71. The two ends of tubular body 10 each has an external thread 13 adapted to mate with internal thread 72 of nut 70. Through nut 70, power connectors 40 are thereby coupled to tubular body 10.

Accordingly, when power supply 30 or light module 20 is inoperable, embodiments of the LED lamp with replaceable power supply allow either component to be repaired or replaced, as opposed to having to dispose the whole LED lamp entirely, thereby significantly reducing operation costs and maximizing use of all electrical components.

What is claimed is:

1. An LED lamp with replaceable power supply, comprising:

a tubular body;

a light module, disposed within the tubular body, the light module including a circuit board and a plurality of LEDs, the plurality of LEDs being electrically coupled to the circuit board and disposed on the bottom side of the circuit board;

a power supply, replaceably disposed on the light module and electrically coupled to the circuit board; and two power connectors, respectively coupled to the two ends of the tubular body and electrically coupled to the power supply.

2. The LED lamp with replaceable power supply according to claim 1, wherein the tubular body comprises a plurality of venting holes thereon.

3. The LED lamp with replaceable power supply according to claim 1, wherein the two ends of the tubular body are each defined a connecting section adapted to couple the two power connectors to the tubular body respectively.

4. The LED lamp with replaceable power supply according to claim 3, wherein each of the connecting sections of the tubular body includes two open grooves and a lock hook defined between the two open grooves, each of the two power connectors including an annular body and lock slots defined on the annular body, the locks slots being adapted to engage with the lock hook in a locking configuration.

5. The LED lamp with replaceable power supply according to claim 1, wherein the light module is replaceably disposed within the tubular body.

6. The LED lamp with replaceable power supply according to claim 1, wherein the LEDs are disposed in a spatial arrangement.

7. The LED lamp with replaceable power supply according to claim 1, wherein the light module further comprises a first power socket electrically coupled to the electric circuit, the power supply having a power supply plug adapted to insert in the first power socket.

8. The LED lamp with replaceable power supply according to claim 1 further comprising two power sink plugs electrically coupled to the two power connectors respectively, the power supply comprising two second power sockets adapted to receive the two power sink plugs respectively.

9. The LED lamp with replaceable power supply according to claim 1, wherein the two power connectors are removably coupled to the two ends of the tubular body.

10. The LED lamp with replaceable power supply according to claim 1 further comprising a nut having a lock groove and an internal thread abutting the lock groove defined therein, each of the two ends of the tubular body having an external thread adapted to mate with the internal thread of the nut, each of the power connectors having a lock ring on an outer edge thereof adapted to fit within the lock groove.

* * * * *